United States Patent [19]

Nishioka

[11] 4,385,618

[45] May 31, 1983

[54] PROJECTILE SHOOTING GUIDE FOR BOWS

[76] Inventor: Jim Z. Nishioka, 1268 Hemlock N.W., Salem, Oreg. 97304

[21] Appl. No.: 203,492

[22] Filed: Nov. 3, 1980

Related U.S. Application Data

[63] Continuation of Ser. No. 775,450, Mar. 8, 1977, abandoned.

[51] Int. Cl.[3] ..... F41B 5/00

[52] U.S. Cl. ..... 124/24 R; 124/90; 124/41 A

[58] Field of Search ..... 124/24 R, 41 R, 41 A, 124/26, 83, 86, 88, 90, 91; 273/428, 416; 46/74 B, 74 A, 74 C

[56] References Cited

U.S. PATENT DOCUMENTS

| | | | |
|---|---|---|---|
| 1,526,176 | 2/1925 | O'Connell | 124/24 R |
| 3,191,342 | 6/1965 | Chalmers | 46/74 B |
| 3,572,311 | 3/1971 | Baer | 124/41 A |
| 4,027,645 | 6/1977 | Damron | 124/24 R |
| 4,146,009 | 3/1979 | Adams | 124/88 |

*Primary Examiner*—Richard C. Pinkham
*Assistant Examiner*—William R. Browne
*Attorney, Agent, or Firm*—Eugene M. Eckelman

[57] ABSTRACT

An elongated guide member is held by a support for associating it with a bow in a longitudinal direction relative to the shooting motion of the bowstring. The guide member slidably receives a projectile arranged to be propelled by the bowstring. The guide member is slidably held in the support so that it can be positioned forwardly when the bow is not being used but can have rearward movement during drawing motion of the bowstring. In one embodiment of the invention, the guide member employs telescoping parts for compacting the length thereof when not in use. A projectile used with the shooting guide preferably has a nocking point forward of its longitudinal center of gravity for stabilized shooting.

4 Claims, 11 Drawing Figures

PROJECTILE SHOOTING GUIDE FOR BOWS

This application is a continuation of application Ser. No. 775,450, filed Mar. 8, 1977, now abandoned.

BACKGROUND OF THE INVENTION

This invention relates to a new and useful projectile shooting guide for bows.

Archery bows have become extremely popular for close range shooting both for hunting and for target shooting. In the use of such bows, arrows are frequently lost or broken, and such amounts to a substantial cost and inconvenience. In addition, the number of arrows that can be carried by the archer is limited in view of their bulkiness.

SUMMARY OF THE INVENTION

According to the present invention and forming a primary objective thereof, projectile guide means are provided which are arranged to be associated with a bow and bowstring for shooting projectiles. Such arrangement of structure allows the archer to accomplish the desired hunting or target practice with the bow but at the same time he can use projectiles which are inexpensive in construction and which are relatively small in size so that there will be a substantial reduction in cost in the event of loss and so that the archer can carry a substantial shooting supply.

Structure for carrying out the invention resides in support means arranged for association with a bow frame for supporting an elongated guide member. The guide member is arranged to guide a projectile engageable by the bowstring for shooting. The guide member, or a portion thereof, is slidably supported on the support means whereby to have rearward motion with the projectile as the bowstring is drawn. In one form of the invention, the projectile has a nocking point forward of its longitudinal center of gravity to provide stabilized shooting thereof. In another form of the invention, means are arranged to be attached to the bowstring and hold one or more projectiles capable of being propelled upon shooting movement of the bowstring. Another structural arrangement is provided which employs driving means attached to the bowstring capable of pushing one or more projectiles out of a guide member.

The invention will be better understood and additional objects and advantages will become apparent from the following description taken in connection with the accompanying drawings.

DETAILED DESCRIPTION OF PREFERRED EMBODIMENTS

Figure 3:
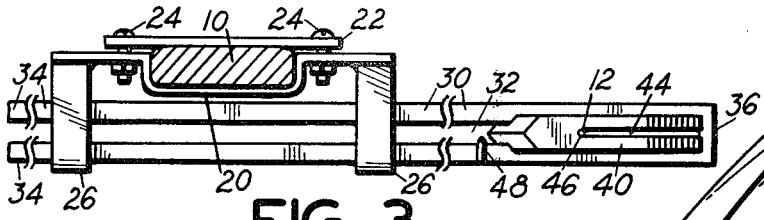
FIG. 3 is an enlarged foreshortened top plan view taken on the line 3—3 of FIG. 1.

With particular reference to the drawings, and first to FIGS. 1–4, there is shown a conventional archery bow having a frame portion 10 and bow limbs 11 or other tensioning means. A bowstring 12 is connected between the limbs. Such bow has the usual hand grip portion 14 and an arrow shelf 16, FIG. 2.

The projectile shooting guide of the present invention is designed for use with archery bows as shown, and it is to be understood that it could be used for other types of bows. The guide comprises a bracket 20 shaped to fit partially around the bow frame portion 10 above the hand grip portion 14. A clamp plate 22 is disposed on the opposite side of the bow from the bracket and is secured to the bracket by bolts 24. The clamp plate 22 securely mounts the bracket on the bow but such assembly is readily removable if desired merely by removing the bolts.

Projecting integrally from the bracket 20 is a pair of support arms 26 having inwardly facing opposed grooves 28 which slidably and nonrotatably receive an elongated guide member 30. This guide member is supported at spaced points by the two arms 26 to have stabilized support on the bracket just above the arrow shelf 16. Guide member 30 has a vertical slot 32 therein which opens through the front 34 and which terminates short of the rearward end to form a closed end 36. Slot 32 forms opposite guide elements.

Figure 4:
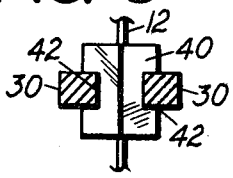
FIG. 4 is an enlarged sectional view taken on the line 4—4 of FIG. 1.
Figure 2:
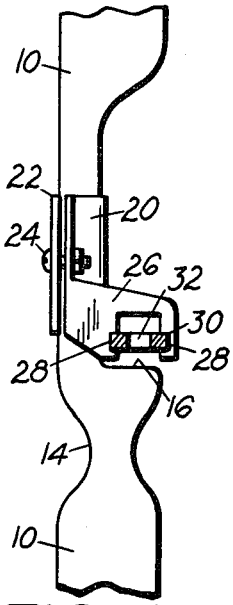
FIG. 2 is an enlarged fragmentary front elevational view of the bow and shooting guide taken on the line 2—2 of FIG. 1.

With reference particularly to FIGS. 3 and 4, a projectile 40 is associated with the guide member 30 for propulsion by the bowstring. The body member of this projectile has side grooves 42 which slidably receive opposite guide elements of the guide member 30. The projectile has a vertical slot 44 extending forwardly from the rearward end thereof to a forward wall or point 46 at the forward end. The slot 44 forms nocking means for the bowstring 12 for shooting the projectile. The forward wall 46 is the nocking point.

In a shooting operation, the projectile is inserted in the open front end 34 of the guide member and moved rearwardly into engagement with the bowstring. The projectile is then pulled rearwardly with the bowstring for drawing the latter, and upon release of the bowstring the projectile is propelled forwardly along the guide member and out the front of the latter. Since the guide member 30 is slidably supported in the bracket 20, it can slide rearwardly in the drawing motion of the bowstring such as to the position shown in broken lines in FIG. 1. Upon release of the bowstring, the guide member will remain stationary and the entire force of the bowstring will act on the projectile. Slidable movement of the guide member relative to the bracket allows it to be readily removed when stored or carried or to be centered for maximum compactness during the time it is supported in the bracket but not in use.

The engagement of the projectile side grooves with the guide member controls the vertical and lateral movement of the projectile as it is drawn and shot. The projectile also controls the lateral movement of the bowstring and protects it from rubbing on the guide member as the bow is drawn and shot. Also, multiple projectiles may be loaded and shot simultaneously. Guide member 30 may employ vertically projecting side plates on the outer edges to further stiffen it.

In a preferred arrangement, the nocking point 46 is forward of the longitudinal center of gravity of the projectile so that the bowstring will have a pulling effect on the projectile during its propelling function, rather than a pushing effect, whereby to provide a stabilized motion thereof in flight.

A flexible retainer 48 is secured on the guide member 30 adjacent the rearward end of the latter and projects into the path of the projectile. This retainer is arranged to hold the projectile rearwardly in the guide member for readiness to be shot but is sufficiently flexible so as not to interfere appreciably with the shooting force applied to the projectile.

Figure 6:
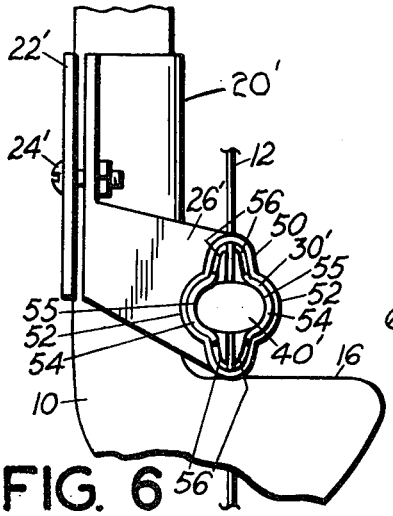
FIG. 6 is an enlarged fragmentary front elevational view taken on the line 6—6 of FIG. 5.

With reference to FIGS. 5–8, an embodiment is shown wherein a guide member 30' has slidable support in a holder 50 and the holder 50 is integral with arms 26' of a bracket 20' removably secured to a bow by a clamp plate 22'. The cross sectional shape of the holder 50 is shown in FIG. 6, such holder comprising an elongated hollow member having side projections 52. The cross sectional shape of the guide member 30' is also shown in FIG. 6, and such member, which is open at its front end and closed at its rearward end 36', has side projections 54 which slidably fit the interior portions of projections 52 of holder 50. The holder 50 is of a length to extend a few inches rearward of the bow and although its combination with the guide member 30' provides the necessary guide length for the projectile in the drawing movements of the bowstring, the two parts 50 and 30' can be telescoped to a minimum over-all length when not in use.

A projectile 40' used with the embodiment of FIGS. 5–8 similarly has a slot 44' leading forwardly from the rearward end thereof and terminating in a forward wall 46' forming nocking means for the bowstring. The projectile 40' has side projections 55 contoured similar to the inner contour of side projections 54 of guide member 30' for guided slidable movement. This projectile also may employ upper and lower wing portions 56 adjacent the front for aligning the bowstring and protecting it from rubbing on the guide member and also for providing gripping means when drawing the bowstring. The wing portions 56 extend above and below the guide member 30' for guided movement, the height and shape of the holder 50 allowing the projectile to pass freely therethrough.

Figure 10:
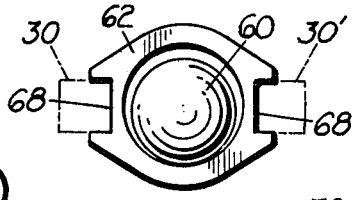
FIG. 10 is an enlarged front elevational view of the projectile of FIG. 9.
Figure 8:
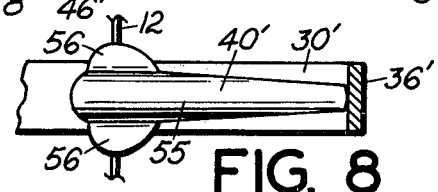
FIG. 8 is a fragmentary sectional view taken on the line 8—8 of FIG. 7.
Figure 9:
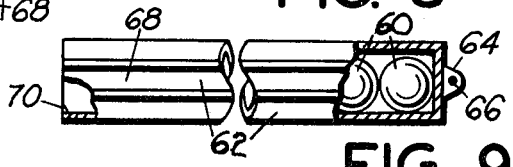
FIG. 9 is a foreshortened plan view, partly broken away, of a modified form of projectile.

With reference to FIGS. 9 and 10, projectiles or pellets 60 are enclosed in a casing 62 open at the front to receive such projectiles. The rearward end of the casing 62 has an ear 64 with a vertical aperture 66 therethrough which encloses the bowstring 12. The sides of the casing 62 are grooved at 68 so as to have slidable support on a guide member such as the member 30 in FIG. 1. In the operation of the embodiment of FIGS. 9 and 10, the casing 62 is charged with a plurality of the projectiles 60 from the front and upon driving the casing forward with the bowstring, the projectiles 60 will be ejected in a shotgun-type pattern, the casing 62 remaining with the bowstring. A flexible retainer 70 is provided at the open front of the casing to hold the projectiles therein. This retainer is sufficiently flexible so as not to interfere with the force applied to the projectiles. The device 62 may be modified and employed with holder 50 and guide member 30' shown in FIGS. 5, 6 and 7. In another arrangement, the forward end of casing 62 may be closed and the casing used as a driving member to push one or more projectiles out of the guide member, the projectiles having slidable engagement in the guide member. In this case, the projectiles may be short in length to form pellet like projectiles and do not require nocking means.

Figure 11:
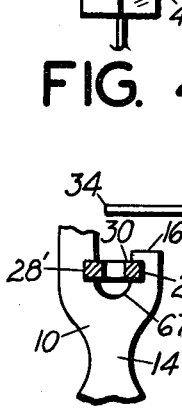
FIG. 11 is a fragmentary front elevational view showing an embodiment wherein the support for the guide member is a part of the bow frame.
Figure 5:
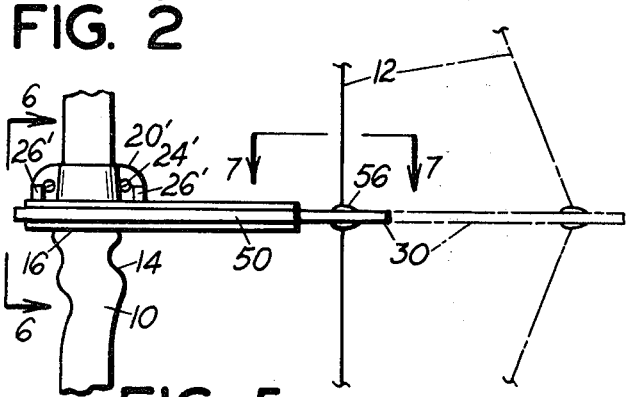
FIG. 5 is a fragmentary side elevational view of a modified form of shooting guide embodying principles of the present invention.

Another embodiment of the projectile shooting guide is shown in FIG. 11. In this embodiment the support is a part of the bow frame 10, the latter having two opposing grooves 28' to slidably receive guide member 30 in supported engagement. A recess 67 in the bow extends below the grooves 28' and allows free passage of the projectile in movements of loading and shooting. Other methods of combining the bow frame and the support may be employed, such as using a dovetailed groove in the bow frame to receive a longitudinal dovetail projection on the guide member.

Figure 1:
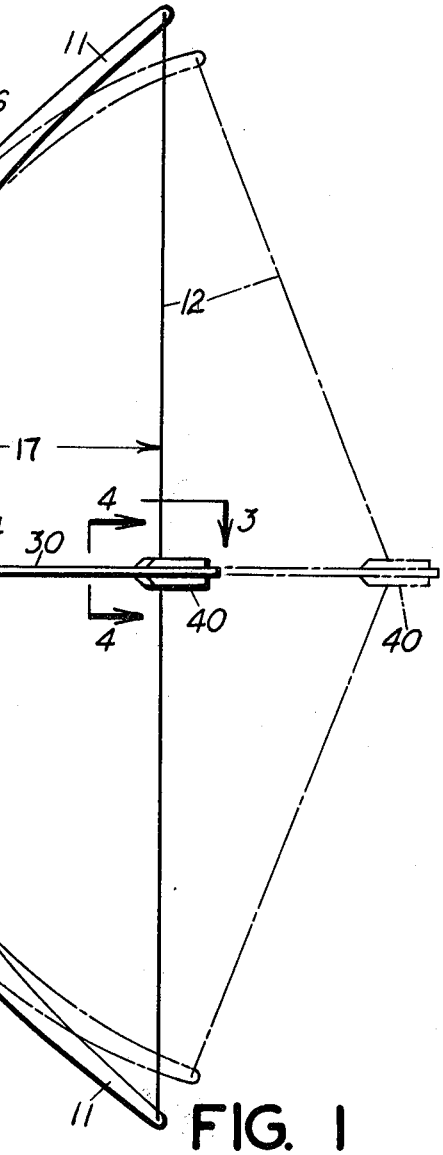
FIG. 1 is a side elevational view of a bow and a first form of shooting guide embodying principles of the present invention.
Figure 7:
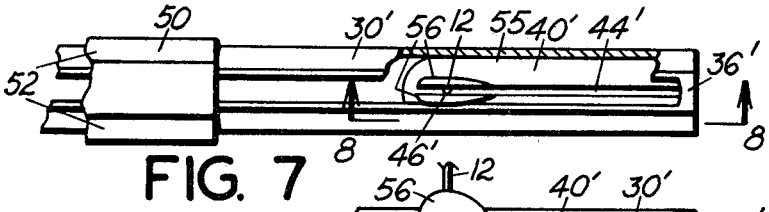
FIG. 7 is an enlarged fragmentary plan view partly broken away, this view being taken on the line 7—7 of FIG. 5.

The projectiles 40 and 40' shown in FIGS. 1 and 7, respectively, are shorter than the bowstring brace height, the brace height comprising the distance designated by the numeral 17 in FIG. 1 and defined by one method as including the distance between the bowstring 12 and the rear edge 16' of the arrow shelf shown in FIG. 1. The projectiles, being shorter than the bowstring brace height, are guided vertically and laterally during drawing and shooting. The guide member accomplishes this in each embodiment.

According to the present invention, the usefulness of a conventional archery bow is considerably extended since the present invention is readily adaptable to most bows and can be used where projectile-type members are more practical than arrows. The use of the inexpensive projectiles allows a person to practice and become proficient with a bow without the expense of using arrows. It is to be understood that the forms of my invention herein shown and described are to be taken as preferred examples of the same and that various changes in the shape, size and arrangement of parts may be resorted to without departing from the spirit of my invention or the scope of the subjoined claims.

Having thus described my invention, I claim:

1. For use with a bow of the type having a bowstring and tensioning means connected to the bowstring, a projectile shooting guide comprising (a) a support for supporting a projectile guide member, said support being mounted for use on a bow, (b) an elongated guide member for support on a bow by said support, (c) said guide member including forward and rearward portions and in an operative position said rearward portion extends rearwardly from said support, (d) projectile guiding means in said guide member for guiding a projectile to be shot by a bowstring, and (e) engaging means on said support means slidably supporting said guide member, (f) said engaging means allowing rearward movement of said guide member while restricting rotating movement of said guide member during drawing movements of said guide member, (g) said projectile guiding means including a slot for slidably receiving a portion of a projectile and extending longitudinally from said rearward portion of said guide member to and through said forward portion of said guide member, (h) said guide member moving with a non-rotating sliding movement during drawing movements thereof.

2. In combination, (a) a bow having a bowstring and tensioning means connected to said bowstring, (b) a support for supporting a projectile guide mmember, said support being mounted on said bow, (c) and an elongated guide member supported on said bow by said support, (d) said guide member extending toward said bowstring and positioned longitudinally in a direction of shooting motion of said bowstring, (e) said guide member being slidably associated with said support and including a pair of parallel elements for slidably supporting a projectile therebetween and for receiving said bowstring therebetween for propelling a projectile, (f) said bowstring operatively engaging said guide member so that said guide member is slidable rearwardly with a drawing movement of said bowstring.

3. For use with a bow of the type having a bowstring and tensioning means connected to the bowstring, a projectile shooting guide comprising (a) a support for slidably supporting a projectile guide member, said support being mounted for use on a bow, (b) an elongated guide member for support on a bow by said support, (c) said guide member including forward and rearward portions and in an operative position said rearward portion extends rearwardly from said support, (d) a projectile guiding means in said guide member for guiding a projectile to be shot by a bowstring, (e) said rearward portion of said guide member including a bowstring receiving means, (f) said bowstring receiving means being rearwardly aligned with said projectile guiding means, (g) means in said projectile shooting guide allowing rearward drawing movements of said rearward portion of said guide member relative to said support so that during operation of said projectile shooting guide said bowstring receiving means and said rearward portion move in unison and in a rearward direction relative to said support.

4. For use with a bow of the type having a bowstring and tensioning means connected to the bowstring, a projectile shooting guide comprising (a) a support for supporting a projectile guide member, said support being mounted for use on a bow, (b) an elongated guide member for support on a bow by said support, (c) said guide member including forward and rearward portions and in an operative position said rearward portion extends rearwardly from said support, (d) projectile guiding means in said guide member for guiding a projectile to be shot by a bowstring, and (e) engaging means on said support slidably supporting said guide member, (f) said engaging means allowing rearward movement of said guide member while restricting rotating movement of said guide member during drawing movements of the latter, (g) said guide member including a pair of parallel elements slidably supported by said support, said engaging means allowing rearward non-rotating sliding movement of said parallel elements during drawing motions of said shooting guide.

* * * * *